United States Patent [19]

Matsuo et al.

[11] 3,975,307

[45] Aug. 17, 1976

[54] PTC THERMISTOR COMPOSITION AND METHOD OF MAKING THE SAME

[75] Inventors: Yoshihiro Matsuo, Neyagawa; Masanori Fujimura, Hirakata; Tomizo Matsuoka, Neyagawa; Shigeru Hayakawa, Hirakata, all of Japan

[73] Assignee: Matsushita Electric Industrial Co., Ltd., Japan

[22] Filed: Oct. 9, 1974

[21] Appl. No.: 513,474

[52] U.S. Cl. ..... 252/520; 252/518; 252/521; 106/73.31; 106/73.32

[51] Int. Cl.[2] ..... H01B 1/08

[58] Field of Search ..... 252/518, 521, 520; 106/73.31, 73.32, 73.3

[56] References Cited

UNITED STATES PATENTS

| | | | |
|---|---|---|---|
| 3,373,120 | 3/1968 | Tsuneharu Nitta et al. | 252/520 |
| 3,586,642 | 6/1971 | Matsuo et al. | 252/521 X |
| 3,674,713 | 7/1972 | Yperman et al. | 252/520 |

FOREIGN PATENTS OR APPLICATIONS

| | | |
|---|---|---|
| 7,383,398 | 11/1973 | Japan |

*Primary Examiner*—Benjamin R. Padgett
*Assistant Examiner*—E. Suzanne Parr
*Attorney, Agent, or Firm*—Wenderoth, Lind & Ponack

[57] ABSTRACT

A PTC thermistor composition comprising $BaTiO_3$, $TiO_2$, one oxide selected from the group consisting of $Nb_2O_5$ and $Y_2O_3$, $Al_2O_3$, $SiO_2$, $Li_2CO_3$, $MnO_2$ and one oxide selected from the group consisting of $Sb_2O_3$ and $Bi_2O_3$, and process for the production thereof are provided. Said process is characterized by the addition of $TiO_2$ and $Nb_2O_5$ to $BaTiO_3$ before calcination and the addition of $Al_2O_3$, $SiO_2$, $Li_2CO_3$, $MnO_2$ and $Sb_2O_3$ after the calcination. This PTC thermistor composition has a high breakdown voltage, a large electric current at the initial moment of a voltage application which current decreases rapidly with continuing voltage application, low specific resistivity and, good stability of resistivity.

16 Claims, 2 Drawing Figures

PTC THERMISTOR COMPOSITION AND METHOD OF MAKING THE SAME

Figure 1:
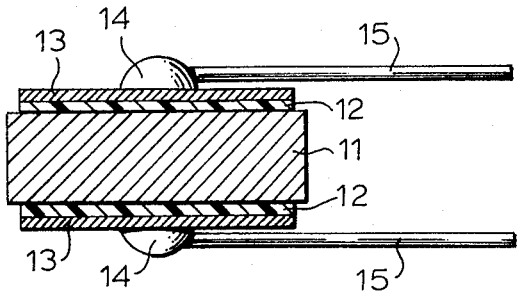

This invention relates to a PTC thermistor composition and particularly to a ceramic PTC thermistor and to a method for producing the PTC thermistor, wherein PTC represents positive temperature coefficient of electrical resistance.

It is well known that barium titanate ceramic exhibits semiconduction when it contains a small amount of an oxide of a metal such as rare earth element, Y, Bi, Sb, Nb and Ta. Such a semiconductive material is disclosed by P. W. Haayman et al. in German Pat. No. 631,321 (1951). It was found by Y. Matsuo et al. in Am. Ceram. Soc. Bull., 47[3]292–297(1968) that the barium titanate ceramic exhibits a semiconduction when it contains a considerable amount of $Al_2O_3$, $SiO_2$. Such a semiconductive material is disclosed by T. Nitta et al. in U.S. Pat. No. 3,373,120 (1968). It was also disclosed by Y. Matsuo et al. in U.S. Pat. No. 3,586,642 (1971) that the semiconductive barium titanate ceramic exhibits a high stability during working under high electric powder when containing a considerable amount of $Al_2O_3$, $SiO_2$ and $TiO_2$ and at the same time a small amount of metal oxide such as $Nb_2O_5$, $Ta_2O_5$, $Sb_2O_3$, $La_2O_3$, $CeO_2$, $Gd_2O_3$, $Sm_2O_3$ and $Y_2O_3$. It was further disclosed by H. Ueoka et al. in Japanese Pat. No. 41-12146/1966 and Japanese Pat. No. 42-3855/1967 that semiconductive barium titanate ceramics doped with a small amount of rare earth element, Bi and Sb exhibit a high positive temperature coefficient of resistivity and a large variation of the resistivity in the PTC temperature region when containing 0.002 to 0.03 percent by weight of Mn ion. It was still further disclosed by N. Fujikawa in Japanese Pat. No. 47-27712/1972 and Japanese Pat. No. 47-41153/1972 that semiconductive barium titanate ceramic doped with a small amount of rare earth element, Bi and Sb exhibits a large variation of the resistivity in the PTC temperature region and a small voltage dependence of the resistivity at a temperature higher than the Curie temperature when containing 0.13 to 0.35 mole percent of Mn ion and with 0.2 to 15 mole percent of Si ion.

Recently, PTC thermistors have been applied to degausing in a Braun tube of a color television, which thermistors are required to have excellent electrical characteristics such as a high breakdown voltage, a large electric current at the moment of electric power application, a small electric current e.g. in 10 or more seconds from a moment of the electric power application, and good stability in an aging test under electrical loading.

Conventional PTC thermistors do not have such excellent characteristics as required. For example, the Mn-doped PTC thermistor incorporated with rare earth element has a high positive temperature coefficient of resistance upon application of a weak electric voltage (usually, a few volts), but cannot persevere in practical usage under the application of a strong electric voltage because the resistivity of the PTC thermistor, which is at a temperature above the Curie point, decreases with increasing electric voltage.

It is, therefore, an object of this invention to provide a PTC thermistor for use in degausing the Braun tube of a color television, characterized by a high breakdown voltage, a large electric current at the initial moment of an electric power application, a small electric current in 10 or more seconds from the initial moment of the electric power application, and good stability in aging under electrical loading.

It is another object of this invention to provide a method of producing a PTC thermistor characterized by a high breakdown voltage, a large electric current at the initial moment of an electric power application, a small electric current in 10 or more seconds from the initial moment of the electric power application, and good stability in aging under electrical loading.

It is a further object of this invention to provide a PTC thermistor characterized by a low specific resistivity at a temperature below the Curie point, a large positive temperature coefficient of resistivity, a large variation of resistivity in the PTC temperature region, a small voltage dependence of the resistivity at a temperature above a Curie point.

Figure 2:
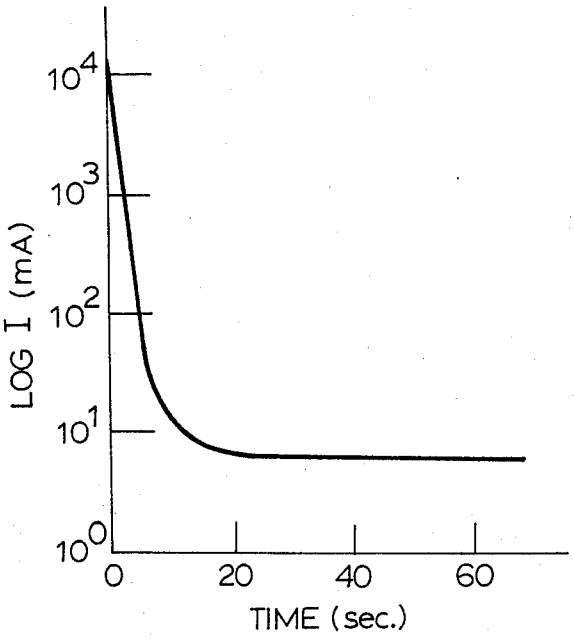

The objects and features of this invention will be apparent from the following description taken together with the accompanying drawings, wherein:

FIG. 1 is a schematic drawing of an exemplary PTC thermistor element with electrodes and lead wires; and FIG. 2 is a graph showing how an electric current through the PTC thermistor comprising the composition according to this invention changes with time from the initial moment of a voltage application to the thermistor.

The PTC thermistor composition according to this invention comprises $BaTiO_3$ as a major element, and as additive elements, $SiO_2$, an oxide selected from the group consisting of $Nb_2O_5$ and $Y_2O_3$, a lithium compound to be converted by air-firing to a lithium oxide, and $MnO_2$ (or a manganese compound to be converted by air-firing to a manganese oxide). The lithium compounds to be converted by air-firing to a lithium oxide are, for example, $Li_2CO_3$, $LiNO_3$, $Li_2SO_4$ and $Li_2C_2O_4$. The manganese compounds to be converted by air-firing to a manganese oxide are, for example, $MnCO_3$, $Mn(NO_3)_2$ and $MnC_2O_4$. This PTC thermistor composition can further include at least one of (1) $TiO_2$, (2) $Al_2O_3$ and (3) one member selected from the group consisting of $Sb_2O_3$ and $Bi_2O_3$. Preferably, the PTC thermistor composition according to this invention consists essentially of $BaTiO_3$ as a base element, and as additives, less than 1.30 percent by weight of $TiO_2$, 0.05 to 0.22 percent by weight of one oxide selected from the group consisting of $Nb_2O_5$ and $Y_2O_3$, less than 1.26 percent by weight of $Al_2O_3$, 0.05 to 1.24 percent by weight of $SiO_2$, 0.007 to 0.09 percent by weight of $Li_2CO_3$, 0.003 to 0.04 percent by weight of $MnO_2$, and less than 0.12 percent by weight of one oxide selected from the group consisting of $Sb_2O_3$ and $Bi_2O_3$. The most desirable composition for the electrical characteristics of said PTC thermistors for use of as degausing consists of 98.84 wt% of $BaTiO_3$, 0.34 wt% of $TiO_2$, 0.125 wt% of $Nb_2O_5$ or $Y_2O_3$, 0.215 wt% of $Al_2O_3$, 0.38 wt% of $SiO_2$, 0.03 wt% of $Li_2CO_3$, 0.02 wt% of $MnO_2$ and 0.05 wt% of $Sb_2O_3$ or $Bi_2O_3$. These additives each take a role in improving the electrical characteristics. The $Nb_2O_5$ or $Y_2O_3$ is necessary to semiconduction of barium titanate according to valency control rule. The $Al_2O_3$, $SiO_2$ and $TiO_2$ which form a liquid phase at a sintering temperature promote the semiconduction, control uniformly the small grain size, and take a role in decreasing voltage dependence of the resistivity at a temperature above Curie point. The $Li_2CO_3$ has a role in enlarging change of resistivity in the PTCR temperature region and lowering the resistivity at a temperature below the Curie point. The $MnO_2$ is effective to enlarge the positive temperature coefficient of resistivity. Further, addition of $Sb_2O_3$ and $Bi_2O_3$ serves to uniformly control the small grain size of the PTC thermistor ceramic and to decrease voltage dependence of the resistivity at a temperature above the Curie point. The combined additives in this invention, cooperate to give a favorable effect on the electrical characteristics.

According to this invention, Ba in $BaTiO_3$ can be partially replaced by Sr and/or Pb, and Ti in $BaTiO_3$ can be replaced by Sn. In producing a PTC thermistor, it is preferable according to this invention that $Al_2O_3$, $SiO_2$, $Li_2CO_3$, $MnO_2$ and $Sb_2O_3$, if used, be added to the starting mixture after per se well known calcination.

The PTC thermistor composition of this invention has excellent electrical characteristics for use as degausing: more than 500V of breakdown voltage at 2 mm thickness of the thermistor element, more than 6.5 ampere of electric current as an initial moment on an application of a voltage of 100 volts, less than 15 milliampere of electric current in 10 seconds from the initial moment of the voltage application, less than 10 milli-ampere of electric current in 60 seconds from the initial moment of the voltage application, less than 3% of a change of resistivity in 10,000 hours under an application of a voltage of 125 volts. Also, the PTC thermistor of the present invention has excellent PTC characteristics: lower than 100 Ω-cm of specific resistivity and larger than 15%/°C of positive temperature coefficient.

Referring to FIG. 1, a schematic drawing of a PTC thermistor element with electrodes and lead wire is shown. In this FIG. 1, 11 is a sintered disk of a PTC thermistor element, 12 is ohmic aluminum electrodes, 13, is copper electrodes, 14 is solder and 15 is lead wires.

FIG. 2 is a graph depicting change of electric current with the lapse of time when a PTC thermistor is supplied with a voltage of 100V.

The PTC thermistors according to this invention are prepared by the process of usual ceramic technique except that $Al_2O_3$, $SiO_2$, $Li_2CO_3$, $MnO_2$ and $Sb_2O_3$, are preferably added after calcination. The starting materials of $BaCO_3$, $TiO_2$ and $Nb_2O_5$ (or $Y_2O_3$) are well mixed in a given composition by ball milling. The mixture is pressed into a pressed body (cake) at a pressure of about 400 kg per $cm^2$. The pressed body is calcined in air at a temperature of 900° to 1250°C for 0.5 to 5 hours, and pulverized. Then, additives of $Al_2O_3$, $SiO_2$, $Li_2CO_3$, $MnO_2$ and $Sb_2O_3$ (or $Bi_2O_3$) are added to the calcined power. They are well mixed by a ball mill and pressed into a pressed body (disk) at a pressure of about 800 kg per $cm^2$. The thus pressed body is sintered in air at a temperature of 1240°C to 1400°C for 0.5 to 5 hours, and cooled to a temperature less than 800°C at a cooling rate of 50°C/hr to 300°C/hr, and is then furnace-cooled to room temperature. As shown in FIG. 1, the body is provided on both surfaces with ohmic aluminum electrodes by a molten Al spraying method. The metal of copper is superposed on the aluminum electrodes by a molten Cu spraying method. Lead wires of nickel are attached to the electrodes by soldering with solders having a melting point of 180°C.

The obtained PTC thermistor is subjected to various tests. The PTC thermistor for testing is in a disk form with a diameter of 13 mm$\phi$ and a thickness of 2 mm. At first, the resistivity of the PTC thermistor is measured at a temperature from −180°C to 400°C. A voltage of 100 V A.C. is supplied between both electrodes of the PTC thermistor. The electric current is measured at the initial moment of an application of 100 V A.C., 10 seconds from the initial moment of the application of the voltage, and in 60 seconds from the initial moment of the application of the voltage. As shown in FIG. 2, it has been found in this invention that the electric current decreases rapidly with the lapse of time. Next, breakdown voltage is measured for a PTC thermistor element without attachment of lead wires by soldering. A weak voltage is applied on the thermistor element and the applied voltage is gradually increased to bring about a thermal breakdown in the thermistor element. Finally, another PTC thermistor element made in the same manner is subjected to aging test under an application of a voltage of 125 V A.C. Change of the resistivity of the PTC thermistor is measured in ten thousands hours from the application of 125V A.C.

It has been discovered in this invention that the addition of Li ion to semiconductive barium titanate doped with Nb or Y enlarges the change of the resistivity in the PTC temperature region, and the addition of $Sb_2O_3$ or $Bi_2O_3$ to semiconductive barium titanate doped with Nb is quite effective to uniformly control the small grain size of the PTC thermistor ceramics, to decrease voltage dependence of the resistivity at a temperature above a Curie point, and to obtain high breakdown voltage. It was also discovered in this invention that the addition of $MnO_2$ to semiconductive barium titanate doped with Nb or Y is effective to enlarge the positive temperature coefficient of resistivity, and all of the additives in this invention provide favorable effects, upon their combination, to improve the electrical characteristics. The additives effect each other. It is further discovered in this invention that the PTC thermistor having the excellent electrical characteristics is prepared by the process characterized by the addition of $Nb_2O_5$ and $TiO_2$ before calcination, and the addition of $Al_2O_3$ $SiO_2$, $Li_2CO_3$, $MnO_2$ and $Sb_2O_3$ after calcination.

It is required to change the PTC onset temperature depending on practical applications of the PTC thermistor. For example, the desirable PTC onset temperature for use in degausing is about 50°C. The PTC onset temperature of the PTC thermistor can be lowered without impairing a semiconductivity by a partial replacement of Ba with Sr or by a partial replacement of Ti with Sn, respectively. The large amount of the replacement results in the lower PTC onset temperature. The preferred amount of replacement of Ba with Sr is less than 40 atomic %. And the preferred amount of replacement of Ti with Sn is less than 30 atomic %.

The PTC thermistor composition can have a higher PTC onset temperature without impairing a semiconductivity when the Ba atoms less than 30 atomic % are partially replaced by an equivalent atomic % of Pb. A higher amount of the replacement results in a higher PTC onset temperature.

EXAMPLE

For the preparation of the PTC thermistor compositions listed in Table I, mixtures of $BaCO_3$, $TiO_2$ and $Nb_2O_5$(or $Y_2O_3$) were well mixed by a wet ball mill, pressed into cakes at a pressure of 400 kg per $cm^2$, and calcined in air at a temperature of 1100°C for 2 hours. The calcined cakes were pulverized. Then, additives of $Al_2O_3$, $SiO_2$ $Li_2CO_3$, $MnO_2$ and one oxide selected from the group consisting of $Sb_2O_3$ and $Bi_2O_3$ were added to the calcined powder. They were well mixed by a wet ball mill, pressed into disks at a pressure of 800 kg per $cm^2$, sintered in air at a temperature of 1350°C for one hour, and cooled at a cooling rate of 100°C/hr.. The sintered disks were provided on both surfaces with ohmic aluminum electrodes by a molten Al spraying method. The copper metal was superposed on the aluminum electrodes by a molten Cu spraying method. Lead wires of nickel were attached to the electrodes by soldering with solders having a melting point of 180°C. The resultant PTC thermistors were measured with respect to the PTC characteristics and the electrical characteristics for use in degausing are, as shown in Table II.

It will be readily understood from Table II that the PTC thermistor compositions contemplated by this invention contribute to superior electrical characteristics of the thermistors for use in degausing. The samples of Nos. 6, 7, 11, 12, 16, 17, 21, 26, 31, 36, 37 and 40 are outside the compositions of this invention. The positive temperature coefficient ($\alpha$) is calculated from the following equation:

$$\alpha = 2.3 \times (\log_{10} R_2/R_1)/(T_2 - T_1)$$

where $T_1$ is the PTC onset temperature, $$T_2 = T_1 + 50(°C),$$

$R_1$ is the electrical resistivity at $T_1$, and
$R_2$ is the electrical resistivity at $T_2$.

Table I

| Sample No. | Principal composition | Additives before calcination (wt%) $TiO_2$ | $Nb_2O_5$ | Additives after calcination (wt%) $Al_2O_3$ | $SiO_2$ | $Li_2CO_3$ | $MnO_2$ | $Sb_2O_3$ | $Bi_2O_3$ |
|---|---|---|---|---|---|---|---|---|---|
| 1 | $(Ba_{0.77}Sr_{0.23})TiO_3$ | 0.34 | 0.125 | 0 | 0.38 | 0.03 | 0.02 | 0 | 0 |
| 2 | " | " | " | 0.04 | " | " | " | " | " |
| 3 | " | " | " | 0.215 | " | " | " | " | " |
| 4 | " | " | " | 0.43 | " | " | " | " | " |
| 5 | " | " | " | 1.26 | " | " | " | " | " |
| 6 | " | " | " | 1.68 | " | " | " | " | " |
| 7 | " | 0.34 | 0.125 | 0.215 | 0.025 | 0.03 | 0.02 | 0 | 0 |
| 8 | " | " | " | " | 0.05 | " | " | " | " |
| 9 | " | " | " | " | 0.125 | " | " | " | " |
| 3 | " | " | " | " | 0.38 | " | " | " | " |
| 10 | " | " | " | " | 1.24 | " | " | " | " |
| 11 | " | " | " | " | 1.65 | " | " | " | " |
| 12 | " | 0.34 | 0.125 | 0.215 | 0.38 | 0.003 | 0.02 | 0 | 0 |
| 13 | " | " | " | " | " | 0.007 | " | " | " |
| 14 | " | " | " | " | " | 0.01 | " | " | " |
| 3 | " | " | " | " | " | 0.03 | " | " | " |
| 15 | " | " | " | " | " | 0.09 | " | " | " |
| 16 | " | " | " | " | " | 0.12 | " | " | " |
| 17 | " | 0.34 | 0.125 | 0.215 | 0.38 | 0.03 | 0.001 | 0 | 0 |
| 18 | " | " | " | " | " | " | 0.003 | " | " |
| 19 | " | " | " | " | " | " | 0.01 | " | " |
| 3 | " | " | " | " | " | " | 0.02 | " | " |
| 20 | " | " | " | " | " | " | 0.04 | " | " |
| 21 | " | " | " | " | " | " | 0.06 | " | " |
| 22 | " | 0.34 | 0.125 | 0.215 | 0.38 | 0.03 | 0.02 | 0.006 | 0 |
| 23 | " | " | " | " | " | " | " | 0.012 | " |
| 24 | " | " | " | " | " | " | " | 0.05 | " |
| 25 | " | " | " | " | " | " | " | 0.12 | " |
| 26 | " | " | " | " | " | " | " | 0.20 | " |
| 27 | $(Ba_{0.77}Sr_{0.23})TiO_3$ | 0.34 | 0.125 | 0.215 | 0.38 | 0.03 | 0.02 | 0 | 0.006 |
| 28 | " | " | " | " | " | " | " | " | 0.012 |
| 29 | " | " | " | " | " | " | " | " | 0.05 |
| 30 | " | " | " | " | " | " | " | " | 0.12 |
| 31 | " | " | " | " | " | " | " | " | 0.20 |
| 32 | " | 0 | 0.125 | 0.215 | 0.38 | 0.03 | 0.02 | 0 | 0 |
| 33 | " | 0.17 | " | " | " | " | " | " | " |
| 34 | " | 0.68 | " | " | " | " | " | " | " |
| 35 | " | 1.30 | " | " | " | " | " | " | " |
| 36 | " | 1.65 | " | " | " | " | " | " | " |
| 37 | " | 0.34 | 0.025 | 0.215 | 0.38 | 0.03 | 0.02 | 0 | 0 |
| 38 | " | " | 0.05 | " | " | " | " | " | " |
| 3 | " | " | 0.125 | " | " | " | " | " | " |
| 39 | " | " | 0.22 | " | " | " | " | " | " |
| 40 | " | " | 0.33 | " | " | " | " | " | " |
| 41 | $(Ba_{0.6}Sr_{0.4})TiO_3$ | 0.34 | 0.125 | 0.215 | 0.38 | 0.03 | 0.02 | 0 | 0 |
| 42 | $Ba(Ti_{0.92}Sn_{0.08})O_3$ | " | " | " | " | " | " | " | " |
| 43 | $Ba(Ti_{0.7}Sn_{0.3})O_3$ | " | " | " | " | " | " | " | " |
| 44 | $(Ba_{0.9}Pb_{0.1})TiO_3$ | " | " | " | " | " | " | " | " |
| 45 | $(Ba_{0.7}Pb_{0.3})TiO_3$ | " | " | " | " | " | " | " | " |
| 46 | $BaTiO_3$ | " | " | " | " | " | " | " | " |
| 47 | " | " | " | " | " | " | " | 0.05 | " |
| 48 | " | " | " | " | " | " | " | 0 | 0.05 |
| 49 | " | 0 | 0.05 | 0 | 0.05 | 0.007 | 0.003 | 0.012 | 0 |
| 50 | " | 1.30 | 0.22 | 1.26 | 1.24 | 0.09 | 0.04 | 0.12 | 0 |
| 51 | $(Ba_{0.77}Sr_{0.23})TiO_3$ | 0.34 | $Y_2O_3$ 0.125 | 0.215 | 0.38 | $Li_2CO_3$ 0.03 | $MnO_2$ 0.02 | 0.05 | 0 |
| 52 | " | " | " | " | " | $Li_2C_2O_4$ 0.03 | $MnCO_3$ 0.02 | 0.05 | 0 |
| 53 | " | " | " | 0 | " | $LiNO_3$ 0.03 | $MnSO_4$ 0.02 | 0 | 0.05 |
| 54 | " | " | " | 0 | " | $Li_2SO_4$ 0.03 | $Mn(NO_3)_2$ 0.02 | 0 | 0 |

Table II

| Sample No. | Specific resistivity (Ωcm) | Positive temperature coefficient of resistivity (%/°C) | Thermal break-down voltage (V) | Current (applied voltage:100V) at a moment of power supply (A) | in 10 second after the moment (mA) | in 60 second after the moment (mA) | Stability 125V 10000H $\frac{\Delta R}{R_o} \times 100$ (%) | PTC oneset temperature (°C) |
|---|---|---|---|---|---|---|---|---|
| 1 | 94 | 16 | 700 | 7.0 | 12.1 | 8.7 | 2.7 | 50 |
| 2 | 72 | 19 | 620 | 9.2 | 12.3 | 7.8 | 2.1 | " |
| 3 | 60 | 22 | 680 | 9.0 | 11.5 | 6.0 | 1.2 | " |
| 4 | 71 | 22 | 680 | 9.2 | 11.7 | 6.1 | 1.4 | " |
| 5 | 96 | 17 | 610 | 7.0 | 12.1 | 7.5 | 1.6 | " |
| 6 | 410 | 12 | >1000 | 1.7 | 1.0 | <1.0 | 8.5 | " |
| 7 | 130 | 13 | 440 | 5.1 | 15.4 | 10.3 | 9.3 | " |
| 8 | 79 | 17 | 500 | 8.4 | 12.5 | 7.7 | 2.5 | " |
| 9 | 68 | 18 | 590 | 9.8 | 11.8 | 6.4 | 2.2 | " |
| 3 | 60 | 22 | 680 | 8.9 | 11.5 | 6.0 | 1.2 | " |
| 10 | 92 | 17 | 620 | 7.2 | 12.3 | 7.1 | 1.3 | " |
| 11 | 170 | 12 | 520 | 3.9 | 14.7 | 9.8 | 4.5 | " |
| 12 | 105 | 16 | 590 | 6.6 | 15.1 | 11.3 | 6.3 | " |
| 13 | 80 | 18 | 620 | 8.3 | 12.5 | 8.4 | 3.0 | " |
| 14 | 70 | 20 | 640 | 9.5 | 11.6 | 6.7 | 2.3 | " |
| 3 | 60 | 22 | 680 | 9.1 | 11.5 | 6.0 | 1.2 | " |
| 15 | 87 | 19 | 670 | 7.7 | 12.2 | 7.1 | 1.6 | " |
| 16 | 450 | 14 | >1000 | 1.5 | <1 | <1 | 5.5 | " |
| 17 | 36 | 11 | 420 | 18.2 | 15.3 | 12.0 | 10.5 | " |
| 18 | 28 | 16 | 520 | 24.3 | 13.2 | 8.7 | 2.4 | " |
| 19 | 35 | 18 | 590 | 18.2 | 11.8 | 7.1 | 1.9 | " |
| 3 | 60 | 22 | 680 | 9.0 | 11.5 | 6.1 | 1.2 | " |
| 20 | 96 | 20 | 640 | 7.0 | 12.0 | 7.4 | 1.4 | " |
| 21 | 590 | 13 | >1000 | 1.2 | <1 | <1 | 3.5 | " |
| 22 | 62 | 22 | 670 | 10.5 | 11.0 | 6.1 | 1.0 | " |
| 23 | 60 | 22 | 720 | 10.7 | 10.5 | 5.4 | 0.7 | " |
| 24 | 73 | 24 | 760 | 9.1 | 10.1 | 5.0 | 0.5 | " |
| 25 | 96 | 23 | 760 | 6.9 | 10.9 | 5.3 | 0.5 | " |
| 26 | 610 | 15 | >1000 | 1.1 | <1 | <1 | 12.3 | " |
| 27 | 60 | 22 | 660 | 11.1 | 11.1 | 5.8 | 1.1 | " |
| 28 | 60 | 22 | 710 | 11.2 | 10.7 | 5.2 | 0.7 | " |
| 29 | 78 | 23 | 740 | 8.6 | 10.3 | 5.1 | 0.7 | " |
| 30 | 95 | 22 | 740 | 7.0 | 11.0 | 5.3 | 0.6 | " |
| 31 | 650 | 14 | >1000 | <1.0 | <1.0 | <1.0 | 12.5 | " |
| 32 | 74 | 20 | 610 | 9.0 | 12.4 | 7.0 | 2.5 | " |
| 33 | 66 | 21 | 650 | 10.1 | 11.9 | 6.8 | 2.0 | " |
| 34 | 70 | 22 | 660 | 9.5 | 11.7 | 6.8 | 1.7 | " |
| 35 | 94 | 22 | 640 | 7.1 | 11.7 | 7.2 | 1.9 | " |
| 36 | 150 | 14 | 500 | 4.5 | 13.1 | 9.3 | 4.7 | " |
| 37 | 590 | 12 | >1000 | 1.1 | <1.0 | <1.0 | 25.0 | " |
| 38 | 90 | 19 | 620 | 7.4 | 11.7 | 6.1 | 2.0 | " |
| 3 | 60 | 22 | 680 | 11.0 | 11.5 | 6.0 | 1.2 | " |
| 39 | 88 | 20 | 630 | 7.6 | 12.0 | 6.4 | 2.8 | " |
| 40 | 430 | 11 | 850 | 1.6 | <1.0 | <1.0 | 11.3 | " |
| 41 | 410 | 16 | >1000 | — | — | — | 1.5 | 0 |
| 42 | 70 | 22 | 670 | 9.4 | 11.4 | 6.0 | 1.7 | 50 |
| 43 | $7\times10^6$ | 15 | >1000 | — | — | — | 1.0 | −110 |
| 44 | 40 | 17 | 440 | — | — | — | 2.5 | 160 |
| 45 | 54 | 16 | 400 | — | — | — | 2.7 | 245 |
| 46 | 35 | 25 | 570 | — | — | — | 1.6 | 120 |
| 47 | 46 | 23 | 600 | — | — | — | 1.2 | 120 |
| 48 | 49 | 22 | 590 | — | — | — | 1.3 | 120 |
| 49 | 70 | 20 | 520 | — | — | — | 2.3 | 120 |
| 50 | 68 | 22 | 580 | — | — | — | 2.1 | 120 |
| 51 | 69 | 23 | 730 | 9.7 | 10.3 | 5.2 | 0.7 | 50 |
| 52 | 70 | 24 | 750 | 9.5 | 10.2 | 5.2 | 0.6 | " |
| 53 | 95 | 16 | 730 | 7.0 | 9.5 | 4.9 | 1.4 | " |
| 54 | 92 | 15 | 680 | 7.2 | 13.6 | 8.9 | 2.8 | " |

What is claimed is:

1. A PTC thermistor composition comprising $BaTiO_3$ as a major element and, as additive elements 0.05 to 1.24 percent by weight of $SiO_2$, 0.007 to 0.09 percent by weight of a lithium compound convertible by air firing to lithium oxide, 0.003 to 0.04 percent by weight of $MnO_2$ or manganese compound convertible by air firing to a manganese oxide, and 0.05 to 0.22 percent by weight of one oxide selected from the group consisting of $Nb_2O_5$ and $Y_2O_3$.

2. A PTC thermistor composition according to claim 1, wherein said lithium compound is one member selected from the group consisting of $Li_2CO_3$, $LiNO_3$, $Li_2SO_4$ and $Li_2C_2O_4$.

3. A PTC thermistor composition according to claim 1, wherein said manganese compound is one member selected from the group consisting of $MnCO_3$, $Mn(NO_3)_2$, and $MnC_2O_4$.

4. A PTC thermistor composition according to claim 1, which further comprises less than 1.30 percent by weight of $TiO_2$.

5. A PTC thermistor composition according to claim 4, which further comprises less than 1.26 percent by weight of $Al_2O_3$.

6. A PTC thermistor composition according to claim 5, which further comprises less than 0.12 percent by weight of one member selected from the group consisting of $Sb_2O_3$ and $Bi_2O_3$.

7. A PTC thermistor composition according to claim 4, which further comprises less than 0.12 percent by weight of one member selected from the group consisting of $Sb_2O_3$ and $Bi_2O_3$.

8. A PTC thermistor composition according to claim 1, which further comprises less then 1.26 percent by weight of $Al_2O_3$.

9. A PTC thermistor composition according to claim 8, which further comprises less than 0.12 percent by weight of $Sb_2O_3$ and $Bi_2O_3$.

10. A PTC thermistor composition according to claim 1, which further comprises less than 0.12 percent by weight of $Sb_2O_3$ and $Bi_2O_3$.

11. A PTC thermistor composition according to claim 1, wherein Ba in $BaTiO_3$ is replaced by an amount of Sr less than 40 atomic percent.

12. A PTC thermistor composition according to claim 1, wherein Ba in $BaTiO_3$ is replaced by an amount of Pb less than 30 atomic percent.

13. A PTC thermistor composition according to claim 1, wherein Ti in $BaTiO_3$ is replaced by an amount of Sn less than 30 atomic percent.

14. A PTC thermistor composition according to claim 1, wherein Ba in $BaTiO_3$ is replaced by an amount of 1 to 30 atomic percent of Sr and by an amount 1 to 20 atomic percent of Pb.

15. A PTC thermistor composition according to claim 1, wherein Ba in $BaTiO_3$ is replaced by an amount of 1 to 20 atomic percent of Pb and Ti is replaced by an amount of 1 to 30 atomic percent of Sn.

16. A method of producing a PTC thermistor comprising preparing a mixture consisting of $BaCO_3$ and $TiO_2$ to be converted into 99.89 to 95.73 percent by weight of $BaTiO_3$, less than 1.30 percent by weight of $TiO_2$ and 0.05 to 0.22 percent by weight of one oxide selected from the group consisting of $Nb_2O_5$ and $Y_2O_3$, calcining the mixture at a temperature of 900 to 1250°C, milling the calcined material with additives of less than 1.26 percent by weight of $Al_2O_3$, 0.05 to 1.24 percent by weight of $SiO_2$, 0.007 to 0.09 percent by weight of $Li_2CO_3$, 0.003 to 0.04 percent by weight of $MnO_2$ and less than 0.12 percent by weight of one oxide selected from the group consisting of $Sb_2O_3$ and $Bi_2O_3$, pressing the mixture of the calcined material and said additives into a pressed body, firing the pressed body at a temperature of 1240°C to 1400°C for 0.5 to 5 hours, thereafter cooling the fired body to a temperature less than 800°C at a cooling rate lower than 300°C per hour, and thereafter cooling the thus cooled body to room temperature.

* * * * *